US009369794B2

(12) United States Patent
Rabu et al.

(10) Patent No.: US 9,369,794 B2
(45) **Date of Patent: *Jun. 14, 2016**

(54) EARBUDS WITH ELECTROSTATIC DISCHARGE PROTECTION

(71) Applicant: Apple Inc., Cupertino, CA (US)

(72) Inventors: Stanley Rabu, Sunnyvale, CA (US); Ida Lo, Sunnyvale, CA (US); Victor Tiscareno, Isaquah, WA (US); Craig Lim, San Jose, CA (US); Ramachandran Chundru, Cupertino, CA (US); Robert Steinfeld, Los Gatos, CA (US); Kurt Stiehl, San Jose, CA (US)

(73) Assignee: APPLE INC., Cupertino, CA (US)

( * ) Notice: Subject to any disclaimer, the term of this patent is extended or adjusted under 35 U.S.C. 154(b) by 456 days.

This patent is subject to a terminal disclaimer.

(21) Appl. No.: 13/849,967

(22) Filed: Mar. 25, 2013

(65) Prior Publication Data

US 2013/0287222 A1 Oct. 31, 2013

Related U.S. Application Data

(63) Continuation of application No. 12/499,785, filed on Jul. 8, 2009, now Pat. No. 8,428,287.

(51) Int. Cl.

| | |
|---|---|
| ***H04R 25/00*** | (2006.01) |
| ***H04R 1/10*** | (2006.01) |
| *H04R 1/26* | (2006.01) |

(52) U.S. Cl.

CPC ..... *H04R 1/1091* (2013.01); *H04R 1/1016* (2013.01); *H04R 1/1033* (2013.01); *H04R 1/1075* (2013.01); *H04R 1/26* (2013.01); *H04R 2201/105* (2013.01)

(58) Field of Classification Search

CPC .. H04R 1/1008; H04R 1/1016; H04R 1/1033; H04R 1/1066; H04R 1/1075; H04R 1/1091; H04R 5/033; H04R 9/06; H04R 25/658; H04R 2201/10; H04R 1/26; H04R 2201/105; H04R 2201/107; H04R 2225/49

USPC ..... 381/309, 322, 324, 328, 72, 74, 370, 381/371, 376, 380, 384, 396, 409, 410; 181/129, 130, 135

See application file for complete search history.

(56) References Cited

U.S. PATENT DOCUMENTS

| | | | | |
|---|---|---|---|---|
| 2,430,229 | A | 11/1947 | Kelsey | |
| 5,887,070 | A | 3/1999 | Iseberg et al. | |
| 6,810,987 | B1 | 11/2004 | DeKalb | |
| 8,428,287 | B2 * | 4/2013 | Rabu et al. | 381/380 |
| 2005/0220319 | A1 | 10/2005 | Chan et al. | |
| 2006/0008106 | A1 | 1/2006 | Harper | |
| 2007/0019821 | A1 | 1/2007 | Dudley | |
| 2007/0121993 | A1 | 5/2007 | Horigome et al. | |
| 2009/0041290 | A1 | 2/2009 | Yang | |

* cited by examiner

*Primary Examiner* — Huyen D Le
(74) *Attorney, Agent, or Firm* — Van Court & Aldridge LLP

(57) ABSTRACT

To avoid undesirable electrostatic discharge events while maintaining low leakage currents, earbuds may be provided with controlled electrostatic discharge paths. The discharge paths may include discrete components such as resistors or more distributed resistive components such as resistive elastomers. A resistive elastomer may be incorporated into an interior portion of an earbud between an earbud housing structure and a ground path. A resistive elastomer may also be used in forming an ear bud tip.

20 Claims, 5 Drawing Sheets

EARBUDS WITH ELECTROSTATIC DISCHARGE PROTECTION

This U.S. continuation Patent Application claims priority from commonly-assigned U.S. patent application Ser. No. 12/499,785, filed Jul. 8, 2009 (now U.S. Pat. No. 8,428,287), which is hereby incorporated by reference herein in its entirety.

BACKGROUND

Headphones are used to play audio for users of electronic devices with media playback capabilities. For example, a pair of headphones may be used to play music for a user of a media player or may handle audio for a cellular telephone user.

Traditional headphones have relatively large ear cups. More recently, smaller headphones known as earbuds have been developed. In some earbud-style headphones, a small plastic earpiece rests in the outer ear canal of the user. Other earbuds have elastomeric earpieces that fit snuggly within a user's ear canal.

Earbuds are used in a variety of environments. For example, earbuds may be plugged into computers or other electronic equipment that is powered from a wall outlet. Earbuds are also used in static-filled environments such as airplanes. Earbuds are sometimes handled roughly, so durability is a concern.

These possible operating environments impose constraints on earbud designers. For example, a durable earbud that is formed from metal parts may be susceptible to electrostatic discharge. Electrostatic charge develops on a user in the course of a user's normal activities. As static electricity builds up on a user's ear, an electrostatic potential can develop across insulating portions of an earbud such as an elastomeric earpiece. If the amount of charge that develops is large enough, an electrostatic discharge event will occur. During the electrostatic discharge event, charge buildup will be released as charge flows across the insulating portions of the earbud. This may produce a spark that is felt by the user or may produce an audible crackle as the charge interacts with the speaker driver in the earbud.

Sparks and audible interference can be unpleasant for users. Although some of these effects can be mitigated by forming earbuds entirely from plastic, conventional all-plastic earbud designs tend not to be aesthetically appealing and may not be sufficiently durable to withstand rough handling. Some conventional earbuds address the effects of electrostatic discharge events by shorting their positive audio lines to metal driver parts in the earbuds. This approach may not be optimal when the earbuds are used with wall-powered equipment, because the positive audio line could potentially become shorted to a live power supply line if the wall-powered equipment were to develop an electrical fault.

It would therefore be desirable to be able to provide earbuds that are able to safely mitigate the effects of electrostatic discharge events.

SUMMARY

Earbuds may be prone to electrostatic discharge events. During an electrostatic discharge event, static charge that is accumulated on a conductive earbud housing or other conductive structure may discharge to a part of the human body (e.g., a user's ear). To avoid undesirable electrostatic discharge events, earbuds may be provided with electrostatic discharge paths.

An earbud may contain a metal speaker driver housing in which a speaker driver is mounted. The earbud may also have a printed circuit board on which electrical components such as speaker crossover circuits for the speaker driver are mounted. The crossover circuits may be used to route audio signals to low-frequency and high-frequency speakers in the metal speaker driver housing.

A pair of earbuds may have an audio plug and associated cable. Signal lines and a ground line in the cable may be used to connect the audio plug to each earbud. In each earbud, the ground line may be connected to ground traces on the printed circuit board to which the crossover elements are mounted. A conductive epoxy may be used to electrically short the ground trace on the printed circuit board to the metal speaker driver housing.

The electrostatic discharge path in each earbud may be formed from an elastomer or other material interposed between the conductive earbud housing and the metal speaker driver housing and ground trace. The elastomer or other electrostatic discharge material may have a resistance that is sufficiently high to avoid undesirable leakage currents but that is sufficiently low to allow electrostatic charge from the conductive earbud housing to discharge to ground.

Further features of the invention, its nature and various advantages will be more apparent from the accompanying drawings and the following detailed description of the preferred embodiments.

DETAILED DESCRIPTION

Media players and electronic devices such as cellular telephones, computers, and other electronic equipment may be used to play media content and present other audio content to a user. Some electronic devices have no internal audio playback capabilities, but can play back audio through an attached set of headphones. Other electronic devices are provided with internal speakers, but still contain audio jacks into which headphones can be plugged when it is desired to use headphones in place of the internal speakers.

Many popular headphones use earbud-style earpieces. Earbuds are more compact than traditional over-the-ear headsets and, particularly when provided with elastomeric in-ear earpieces, can help provide sound isolation.

Some conventional earbuds are formed almost entirely of insulating materials such as plastic. These devices tend to resist electrostatic discharge, but can be unsightly and fragile.

Other conventional earbuds may include durable metal parts over which soft elastomeric earpieces are formed, but are subject to electrostatic discharge events or use sub-optimal connections for their signals lines.

Figure 1:
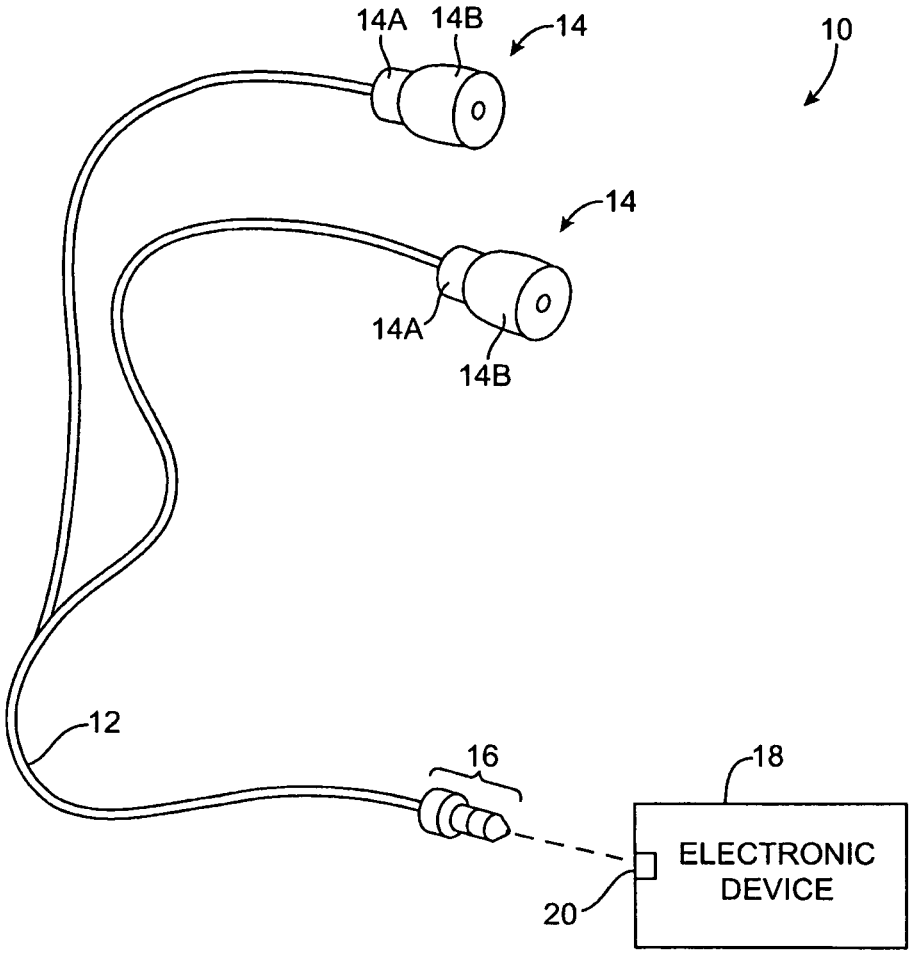
FIG. 1 is a perspective view of an illustrative set of earbud headphones accordance with an embodiment of the present invention.

A set of earbud headphones having a design that helps to mitigate electrostatic discharge effects is shown in FIG. 1. As shown in FIG. 1, earbud headphones 10 may have a cable 12, earbuds 14, and an audio connector such as audio plug 16. Audio plug 16 may mate with a corresponding jack such as jack 20 in electronic device 18.

Audio plug 16 and mating audio jack 20 can be provided in a variety of form factors. For example, audio jacks and plugs can have different sizes (e.g., ¼", ⅛" or 3.5 mm, etc.). Audio jacks and plugs can also have different numbers of contacts. For example, audio connectors such as these may have two contacts for audio and ground or may have three contacts to support left and right stereo audio signals and ground. Some audio connector arrangements use four or more audio connectors. For example, a four-contact connector may have left and right audio contacts, a microphone contact, and a ground contact.

A typical three-pin audio connector has a tip contact, a ring contact, and a sleeve contact and is therefore sometimes referred to as a tip-ring-sleeve (TRS). A four-pin audio connectors may have a tip, two rings, and a sleeve. Four-pin audio connectors are therefore sometimes referred to as tip-ring-ring-sleeve (TRRS) connectors. These audio connector arrangements or other suitable audio connector arrangements may be used in headphones 10 if desired.

Device 18 may be a media player, a cellular telephone player with media player capabilities, a portable electronic device such as a computer, a smaller portable electronic device such as a pendant or wrist device, or any other suitable electronic device.

The functions of device 18 may be implemented using storage and processing circuitry. Storage in the storage and processing circuitry may include volatile and non-volatile memory and may be provided using stand-alone memory chips, memory that is incorporated into a processor, application-specific integrated circuit, or other component, solid state memory devices, hard drives, or other suitable storage components. Processing circuitry in the storage and processing circuitry may be implemented using one or more processors. Examples of integrated circuits that may be used in providing processing capabilities for device 18 include microprocessors, microcontrollers, digital signal processors, audio and video chips (codecs), application-specific integrated circuits, communications circuits, etc.

Cable 12 may include two, three, four, or more than four conductive wires. Cables with fewer wires may only be able to support monaural audio. Cables with more wires may be able to support more advance functions, such as stereo audio, microphone signals for voice calls, and data signals (e.g., for user input from a user input device or for user output for a status indicator). Cable 12 in the example of FIG. 1 has three wires for left audio, right audio, and a shared ground. This type of arrangement is, however, merely illustrative. Cable 12 may, in general, have any suitable number of conductive lines each of which may be connected to a respective conductive contact in audio connector 16.

Earbuds 14 contain speaker drivers. Each earbud 14 may contain a single driver or each earbud may contain two or more driver elements. For example, high-quality audio may be played back for a user with a two-speaker arrangement. In a typical two-speaker arrangement, each earbud 14 may contain a woofer driver for reproducing low frequencies and a tweeter driver for reproducing high frequencies. Other arrangements may be used if desired (e.g., with midrange drivers, subwoofers, etc.).

Earbuds 14 may be constructed from conductive materials such as metal (including elemental metals and metal alloys) and from insulating structures such as plastic and elastomeric substances. In earbuds that fit in the outer portions of a user's ear, it may be acceptable to use rigid polymers such as acrylonitrile butadiene styrene (ABS), polycarbonate (PC), or PC/ABS blends or other relatively hard materials to form earbud structures. In earbuds that fit within the ear canal of a user (sometimes referred to as in-canal or in-ear earbuds), it may be desirable to form the part of the earbud that contacts the user's ear from a soft elastomer such as foam or silicone.

To ensure sufficient durability and to enhance aesthetics, it may be desirable to form at least part of earbuds 14 from a conductor such as metal. For clarity, earbud arrangements in which part of the earbud is formed from metal and part of the earbud is formed from an insulator such as a soft elastomer or rigid plastic are described herein as examples. In the example of FIG. 1, each earbud has a metal housing portion 14A and an insulating portion 14B. Housing portions 14A may be formed from stainless steel or other suitable metals. Insulating portion 14B may be formed from silicone, foam, or other elastomeric substances (as examples).

Figure 2:
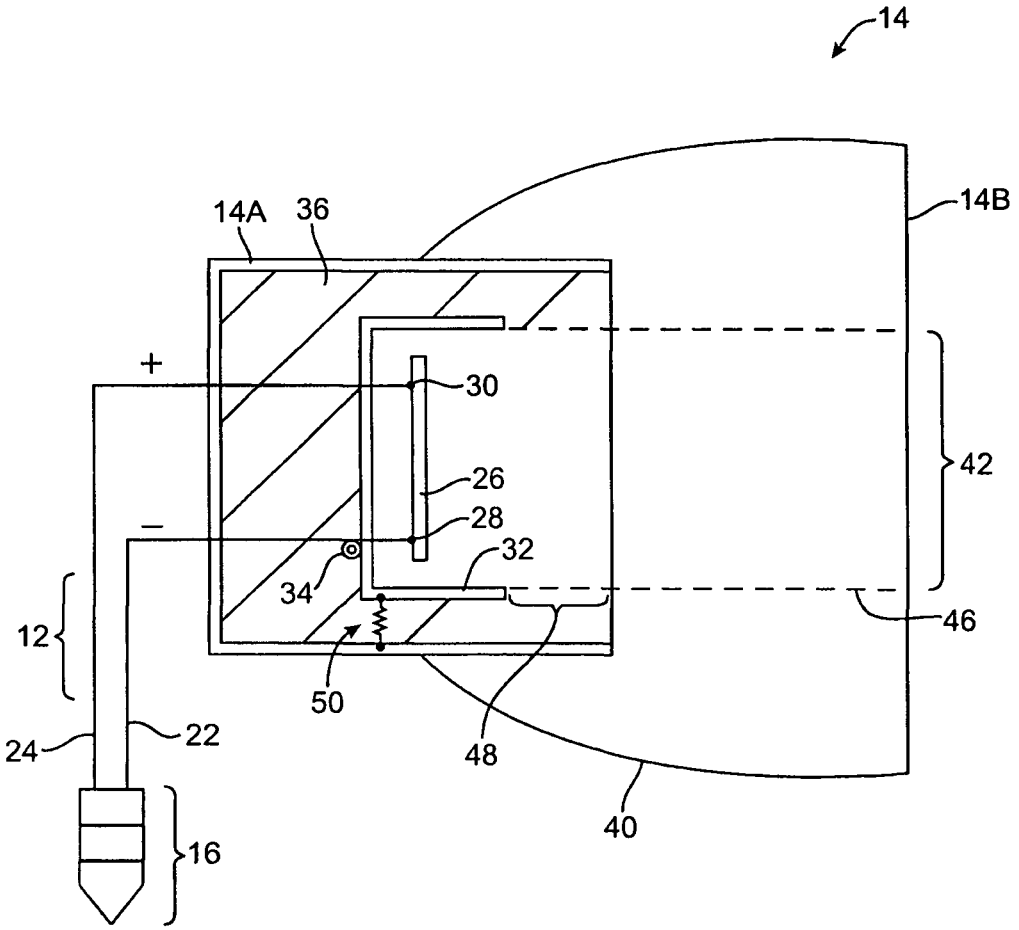
FIG. 2 is a cross-sectional view of an illustrative earbud with a resistive material that provides a controlled discharge path for electrostatic charge in accordance with an embodiment of the present invention.

A partly schematic cross-sectional side view of one of earbuds 14 is shown in FIG. 2. As shown in FIG. 2, audio jack 16 may be connected to wires 22 and 24 in cable 12. Only one channel of audio is being handled in the example of FIG. 2, so there is a single audio line (positive line 24) and a corresponding ground (ground line 22) depicted in the drawing.

Lines 24 and 22 may be routed to corresponding positive speaker driver terminal 30 and ground speaker driver terminal 28 on speaker driver 26. Speaker driver 26 may contain one or more speakers that produce sound for earbud 14.

Portion 14A of earbud 14 may be formed of metal. Portion 14B may be formed of an insulator such as an elastomer or a rigid plastic. Because portion 14B is often formed from elastomeric materials, portion 14B of earbud 14 is sometimes referred to herein as elastomeric ear-canal structure 14B.

Structure 14B has openings to allow sound to escape from the interior of earbud 14. In particular, structure 14B has an interior channel 46 that terminates in exterior opening 42. Interior channel 46 may be a hollow cylinder and exterior opening 42 may be a circular hole (as examples).

Electrostatic charge can build up on earbud 14 during use. For example, in the absence of a suitable electrostatic discharge path, portion 14A might become charged when contacted by a user's ear.

To prevent excessive amounts of electrostatic charge from developing and thereby prevent electrostatic discharge events, headphones 10 may be provided with a controlled electrostatic discharge path. The discharge path may be formed within portions of the headphones such as cable 12 and plug 16 or, more preferably, as part of earbud 14. With one suitable arrangement, which is sometimes described herein as an example, earbud 14 may be provided with structures that form a resistive discharge path between metal portion 14A and a suitable discharging structure such as ground line 22.

In the example of FIG. 2, earbud 14 has been provided with resistive electrostatic discharge material 36. Material 36 may be, for example, a resistive foam or rubber. Conductive particles such as carbon particles or other suitable filler materials may be incorporated into material 36 to ensure that material 36 has a non-zero conductivity and does not act as an insulator. Satisfactory materials 36 will exhibit a sufficiently low resistance to allow current to flow to discharge electrostatic charge buildup.

With one suitable arrangement, material 36 may be implemented in the form of a ring-shaped boot member that circumferentially surrounds driver 26. Boot member 36 may have a conductivity of about $2*10^{-5}$ to $4*10^{-7}$ $(\Omega\text{-m})^{-1}$. In an earbud having dimensions of about 1 mm to about 1 cm, boot member 36 may have a resistance of about 500 kΩ to 10 MΩ (e.g., less than 30 MΩ, between 30 MΩ and 10 MΩ, between 40 MB and 300 kΩ, between 30 MΩ and 1 MΩ, less than 20 MΩ, less than 10 MΩ, less than 1 MΩ, etc.) The resistance of boot member 36 is preferably low enough to bleed off electrostatic charge while being high enough to prevent undesirable leakage currents from developing. Material 36 is somewhat conductive, so whenever electrostatic charge develops on metal structure 14A, this charge will be discharged through member 36.

As shown in FIG. 2, driver 26 may be mounted in driver body 32. Body structure 32 may be formed from metal. Lines 22 and 24 may pass through holes in metal member 32 and may be electrically connected to driver 26 at terminals 28 and 30. To ensure that driver body 32 is shorted to ground, conductive epoxy 34, a spring contact, or other conductor may be connected between ground line 22 and driver body 32. If a user's ear or other body part touches earbud housing 14A and causes housing 14A to become electrostatically charged, this charge can be discharged by flowing through resistive material 36 to driver body 32 (and thereafter through conductor 34 to ground line 22). As shown by segment 48 of dashed line 46, the opening that was formed through earbud portion 14B may extend through resistive member 36. This allows sound from driver 26 to escape from the interior of earbud 14.

If desired, other types of electrostatic discharge path may be formed between housing 14A and ground line 22. For example, as shown in FIG. 2, one or more discrete resistors such as resistor 50 may be electrically connected between metal housing 14A and driver body 32. The ends of resistor 50 may be connected to housing 14A and body 32 using welds, solder connections, metal springs, or other suitable connections. Earbuds may also be provided with both a distributed discharge path resistance (e.g., material 36) and discrete resistors (e.g., resistor 50).

Electrostatic discharge events may be associated with relatively large voltages. For example, voltages may build up to 5 kV or 10 kV or more. To ensure that resistor 50 is able to withstand these relatively large voltages without damage, resistor 50 may be implemented using a high-voltage design (e.g., a thin-film resistor that is formed from a durable material such as ruthenium oxide and that has a shape that helps prevent voltages from jumping across the resistor housing). More than one resistor 50 may be connected between metal housing 14A and driver body 32 in parallel if desired. Multiple series-connected resistors 50 may also be used. Arrangements with parallel and series-connected discrete high-voltage resistors may be used instead of distributed resistance material 36 or may be used in the same earbud as material 36.

In the illustrative configuration of FIG. 2, resistor 50 is surrounded by material 36 (e.g., a resistive elastomer). This type of configuration may help physically block air discharges around resistor 50 and thereby ensure that resistor 50 is not inadvertently bypassed by an arc through an air gap. If desired, other structures such as non-conductive plastic barrier structures in which resistor 50 is buried may be placed between housing 14A and driver body 32. When a barrier such as this is provided in earbud 14 to help prevent inadvertent air discharges, it may be desirable to form resistor 50 from a compact resistor such as a small surface mount technology (SMT) resistor. Larger resistors (e.g., high-voltage resistors in larger packages) may also be sealed within a barrier structure such as a plastic barrier. The barrier in which resistor 50 is mounted may have the shape of material 36 of FIG. 2 or may have other suitable shapes that force ESD currents to flow through resistor 50 while preventing parallel air discharges.

Figure 3:
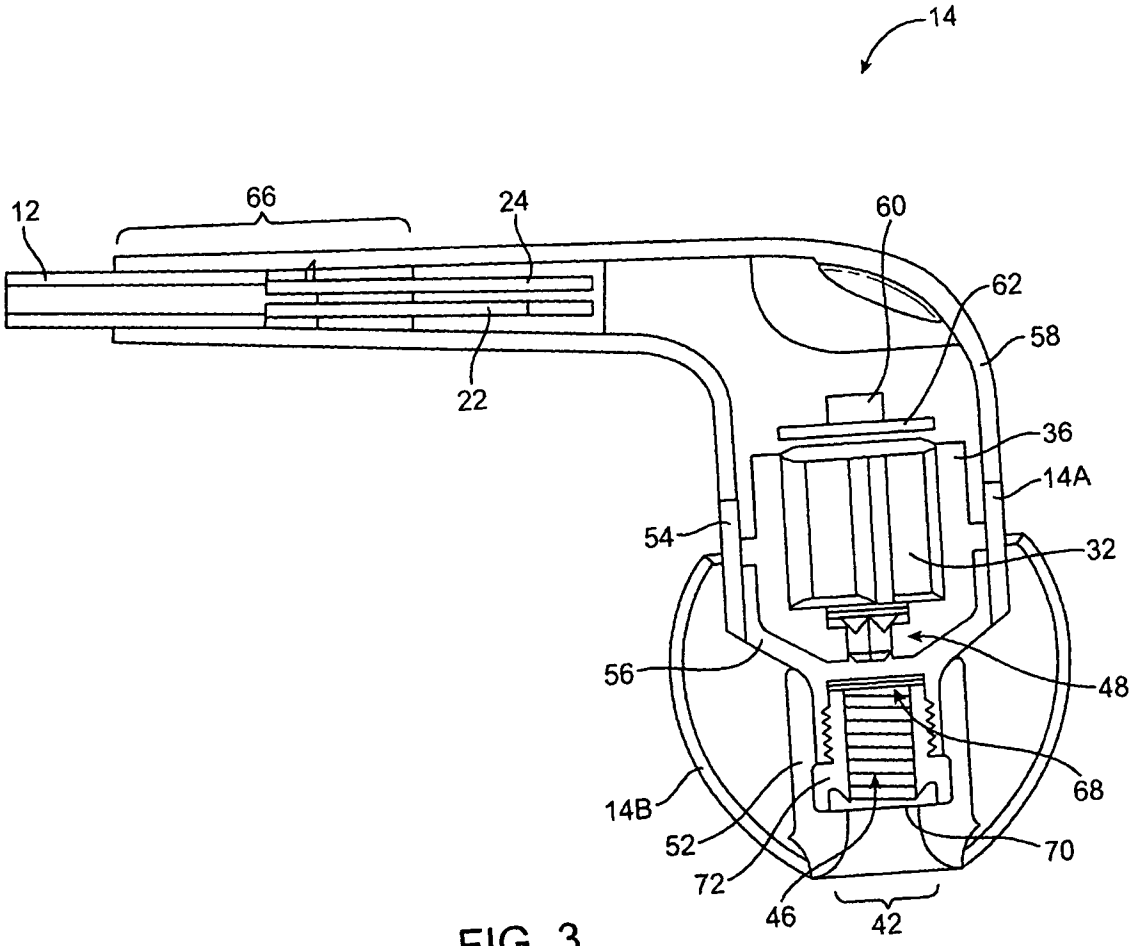
FIG. 3 is a cross-sectional view of another illustrative earbud with a resistive material that provides a controlled discharge path for electrostatic charge in accordance with an embodiment of the present invention.

A cross-sectional side view of another illustrative earbud 14 with an internal electrostatic discharge path is shown in FIG. 3. As shown in FIG. 3, earbud 14 may have metal housing portion 14A. Metal housing 14A may include outer metal housing member 54 and inner metal housing member 56. Plastic housing 58 may be used to route wires 22 and 24 from cable 12 to crossover filter 60 and other circuitry on printed circuit board 62. Strain-relief portion 66 of housing 58 may receive the end of cable 12 and may, if desired, be formed from an elastomeric substance to allow cable 12 to flex in the vicinity of earbud 14.

Conductive epoxy 34 (FIG. 2) may be placed between board 62 and driver body 32 as described in connection with FIG. 2. Earbud member 14B (e.g., a dielectric earbud member such as an elastomeric earbud member or other ear tip structure) may be connected to metal housing portion 14A. Channel 46 may be formed within center core portion 52 of elastomeric ear tip member 14B. Discharge structure 36 may be formed from a non-insulating material (i.e., a slightly conductive material with a non-zero conductivity). Structure 36 may be implemented using a conductive rubber boot structure that surrounds driver body 32. Channel 46 may be formed through ear bud member 14B and rubber boot 36.

To prevent particle intrusion into the interior of driver body 32, which could damage the speakers of driver body 32, one or more screens may be provided in earbud 14. These screens may be, for example, polymer screens, metal screens, screens formed from combinations of polymer and metal parts, etc. In the example of FIG. 3, threaded cap member 72 may be screwed into mating threads in member 56 and may hold screen 68 in place across channel 46. An external screen such as screen 70 may also be attached to cap member 72. Screen 68 may be, for example, a polyester acoustic and particle filter, whereas screen 70 may be a wire mesh that prevents foreign objects from entering channel 46.

If desired, earbud structure 14B may be used to discharge electrostatic charge (e.g., to ground line 22). An earbud structure of this type may be formed from a conductive (non-insulating) material and may exhibit a resistance of about 10-30 MΩ. A conductive (resistive) earbud structure of this type may be used in the same earbud 14 as conductive rubber boot 36 or may be used in an earbud without any other internal electrostatic discharge paths. Conductive (resistive) discharge paths may also be formed in cable 12 (e.g., by forming some or all of the jacket in cable 12 from a material that has a non-zero conductivity and by shorting the jacket to ground 22 or other suitable discharge path).

Figure 4:
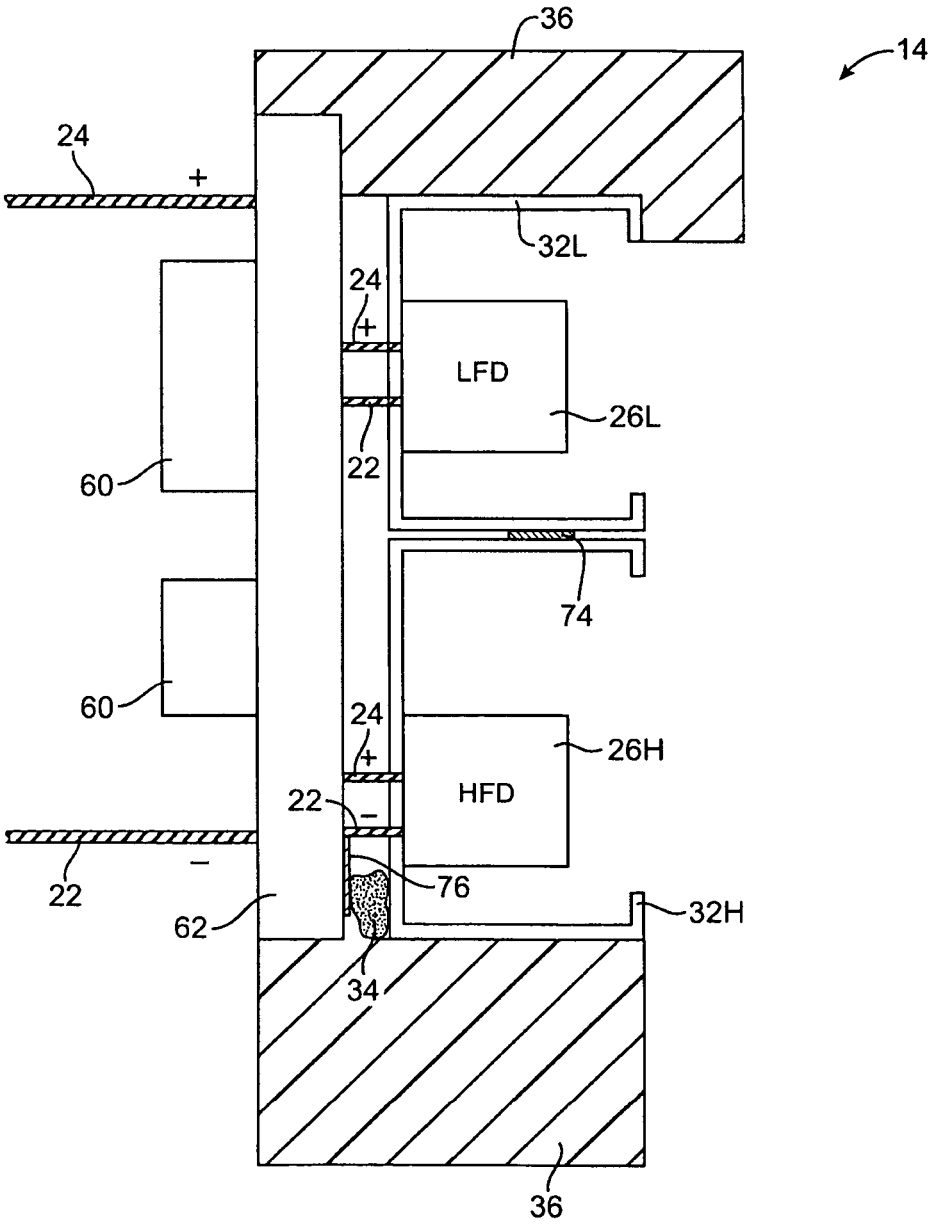
FIG. 4 is a cross-sectional view of an interior portion of an earbud with a resistive elastomer that serves as an electrostatic discharge path in accordance with an embodiment of the present invention.

A cross-sectional view of earbud 14 in the vicinity of printed circuit board 62 is shown in FIG. 4. As shown in FIG. 4, earbud 14 may have a printed circuit board 62 to which electrical circuits such as circuits 60 may be mounted. Circuits 60 may include crossover components, amplifier components, and other suitable audio circuits. Audio signals may be received using positive signal wire 24 and ground wire 22.

There may be two or more speaker driver modules in earbud 14. In the example of FIG. 4, earbud 14 includes low frequency driver 26L (a "woofer") and high frequency driver 26H (a "tweeter"). Drivers such as drivers 26L and 26H may be provided in one or more separate housings. For example, driver 26L may be provided in metal driver housing 32L and driver 26H may be provided in metal driver housing 32H. To ensure satisfactory electrostatic discharge, housings 32L and 32H may be electrically connected (e.g., using solder 74). Conductive epoxy, a conductive spring, or other suitable conductive structure 34 may be used to electrically connect driver housing 32H to ground 22 (e.g., to ground trace 76 on board 62, which is connected to ground 22).

Figure 5:
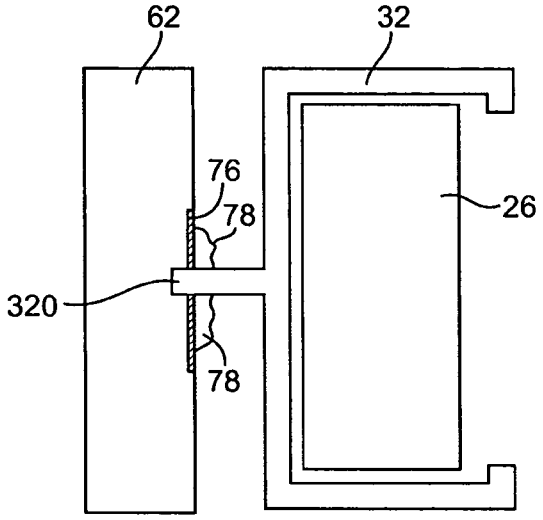
FIG. 5 is a cross-sectional view of an interior portion of an earbud showing how a driver housing member may be soldered to a ground trace on a driver printed circuit board in accordance with an embodiment of the present invention.

Arrangements of the type shown in FIG. 4 work well with existing driver modules, because conductive epoxy 34 can be used to short cases 26L and 26H to ground trace 76 without introducing high temperatures that might damage the headphone speakers. If desired, however, higher temperature processes may be used. As shown in FIG. 5, for example, driver housing 32 of driver 26 may have a protrusion such as shorting member 320. Housing 32 may be formed from metal and shorting member 320 may be formed from a portion of the same metal. Shorting member 320 may be inserted in a hole in printed circuit board 62. Solder 78 may be used to form a solder connection between shorting member 320 and ground trace 76. This shorts driver housing 32 to ground line 22 (see FIG. 4), which is electrically connected to ground trace 76.

If desired, other structures may be used to receive electrostatic discharge current through boot member 36. For example, a metal screen (e.g., a stainless steel mesh such as screen 70 of FIG. 3) may be shorted to ground 22 (e.g., using a wire, using a connection to a trace on a board or other metal structure, etc.). Boot member 36 may be electrically connected to screen 70, so that boot member 36 forms an electrostatic discharge path through boot member 36 into screen 70 and ground 22.

The foregoing is merely illustrative of the principles of this invention and various modifications can be made by those skilled in the art without departing from the scope and spirit of the invention.

What is claimed is:

1. Headphones comprising:
a housing;
a driver module at least partially within the housing; and
a first conductive structure that provides a first electrostatic discharge path between the housing and the driver module.

2. The headphones of claim 1, wherein the first conductive structure comprises a resistor.

3. The headphones of claim 1, further comprising a nonconductive barrier structure between the housing and the driver module, wherein the first conductive structure is mounted within the nonconductive barrier structure.

4. The headphones of claim 1, further comprising a nonconductive barrier structure between the housing and the driver module, wherein the nonconductive barrier structure prevents air discharges around the first conductive structure.

5. The headphones of claim 4, wherein:
the first conductive structure comprises at least one resistor; and
the nonconductive barrier structure prevents air discharges around the at least one resistor.

6. The headphones of claim 1, wherein the first conductive structure comprises an elastomeric substance interposed between the housing and the driver module.

7. The headphones of claim 1, wherein the first conductive structure circumferentially surrounds the driver module.

8. The headphones of claim 1, further comprising a ground terminal that is configured to be electrically coupled to a ground line of a cable.

9. The headphones of claim 8, further comprising a second conductive structure that electrically couples the driver module to the ground terminal.

10. The headphones of claim 9, wherein the second conductive structure provides a second electrostatic discharge path between the driver module and the ground terminal.

11. The headphones of claim 9, wherein the driver module electrically couples the first conductive structure and the second conductive structure.

12. The headphones of claim 9, wherein the second conductive structure comprises at least one of solder, conductive epoxy, and a conductive spring.

13. The headphones of claim 1, wherein:
the driver module comprises a first driver mounted in a first driver body; and
the first conductive structure provides the first electrostatic discharge path between the housing and the first driver body.

14. The headphones of claim 1, wherein:
the driver module comprises:
a first driver body;
a first driver mounted in the first driver body; and
a first driver screen configured to prevent particle intrusion into the first driver body; and
the first conductive structure provides the first electrostatic discharge path between the housing and the first driver screen.

15. The headphones of claim 1, wherein:
the driver module comprises:
a first driver mounted in a first driver body; and
a second driver mounted in a second driver body; and
the headphones further comprising an electrical coupler that electrically couples the first driver body to the second driver body.

16. The headphones of claim 15, further comprising:
a ground terminal that is configured to be electrically coupled to a around line of a cable; and
a second conductive structure that electrically couples the second driver body to the ground terminal, wherein:
the first conductive structure provides the first electrostatic discharge path between the housing and the first driver body;
the electrical coupler provides a second electrostatic discharge path between the first driver body and the second driver body; and
the second conductive structure provides a third electrostatic discharge path between the second driver body and the ground terminal.

17. Headphones comprising:
a housing;
a driver module positioned at least partially within the housing; and
a ground terminal that is operable to be electrically coupled to a ground line of a cable, wherein the driver module provides at least a portion of an electrostatic discharge path between the housing and the ground terminal.

18. The headphones of claim 17, further comprising a first conductive structure that provides a first portion of the electrostatic discharge path between the housing and the driver module.

19. The headphones of claim 18, wherein the first conductive structure comprises at least one of a discrete resistor and an elastomeric substance.

20. Headphones comprising:
a housing;
a driver module at least partially within the housing;

a ground terminal that is configured to be electrically coupled to a ground line of a cable; and a first conductive structure that provides at least a portion of an electrostatic discharge path between the housing and the ground terminal, wherein at least a portion of the first conductive structure is positioned in a space between the housing and the driver module.

* * * * *